US012410915B2

(12) United States Patent
Mumcu

(10) Patent No.: US 12,410,915 B2
(45) Date of Patent: Sep. 9, 2025

(54) DC RE-IGNITION SYSTEM FOR A GAS BURNER

(71) Applicant: FEREL ELEKTRONIK SAN. VE TIC. A.S., Istanbul (TR)

(72) Inventor: Sinan Mumcu, Istanbul (TR)

(73) Assignee: FEREL ELEKTRONIK SAN. VE TIC. A.S., Istanbul (TR)

( * ) Notice: Subject to any disclaimer, the term of this patent is extended or adjusted under 35 U.S.C. 154(b) by 3 days.

(21) Appl. No.: 17/926,028

(22) PCT Filed: May 22, 2020

(86) PCT No.: PCT/TR2020/050450

§ 371 (c)(1),
(2) Date: Nov. 17, 2022

(87) PCT Pub. No.: WO2021/236030

PCT Pub. Date: Nov. 25, 2021

(65) Prior Publication Data

US 2023/0175694 A1 Jun. 8, 2023

(51) Int. Cl.
*F23Q 3/00* (2006.01)
*F24C 3/10* (2006.01)

(52) U.S. Cl.
CPC ..... *F23Q 3/008* (2013.01); *F24C 3/103* (2013.01)

(58) Field of Classification Search
CPC ..... F23Q 3/008; F24C 3/103
USPC ..... 431/264
See application file for complete search history.

(56) References Cited

U.S. PATENT DOCUMENTS

| | | | | |
|---|---|---|---|---|
| 3,883,246 | A | 5/1975 | Courier de Mere | |
| 3,894,273 | A | 7/1975 | Newport, Jr. et al. | |
| 4,032,922 | A * | 6/1977 | Goto | F23Q 2/285 431/264 |
| 4,565,519 | A | 1/1986 | Carignan | |
| 4,717,333 | A | 1/1988 | Carignan | |
| 5,169,303 | A * | 12/1992 | Paluck | F23Q 3/004 431/74 |
| 2006/0219691 | A1 * | 10/2006 | Hamel | F23Q 7/22 219/267 |

(Continued)

OTHER PUBLICATIONS

International Search Report & Written Opinion, International Application No. PCT-TR2020-050450, dated Oct. 14, 2021, 7 pages.

(Continued)

*Primary Examiner* — Vivek K Shirsat
(74) *Attorney, Agent, or Firm* — Bayramoglu Law Offices LLC

(57) ABSTRACT

The invention relates to a re-ignition system for a gas device comprising an electrode element (1) provided next to a burner (2); an igniter (60) in communication with the electrode element (1) for transmitting electrical signal and providing a spark arc with high voltage towards burner (2) in electrode element (1) in ignition mode; and an ignition control unit (30). Re-ignition system further comprises at least one battery (10); a flame detection unit (50) receiving a flame presence signal (3) by flame rectification and a transformer (20) which converts the direct current supplied through the battery (10) from one inlet (22) to alternating current at an outlet (24) and is connected with the ignition control unit (30) and flame detection unit (50) to provide electrical signal.

9 Claims, 8 Drawing Sheets

(56) References Cited

U.S. PATENT DOCUMENTS

2016/0348916 A1* 12/2016 French et al. ..... F16K 31/524

OTHER PUBLICATIONS

International Preliminary Report on Patentability, International Application No. PCT-TR2020-050450, dated Nov. 17, 2022, 5 pages.

* cited by examiner

DC RE-IGNITION SYSTEM FOR A GAS BURNER

TECHNICAL FIELD

The present invention relates to a reignition system for a device having a gas burner that restarts the ignition sequence in the flame-out condition.

BACKGROUND OF THE INVENTION

Devices with gas burner are equipped with a re-ignition system to ignite the fuel after reaching the burner and ensure the presence of the flame. Such devices have an electrical igniter that generate spark during a fuel such as the mixture of air and natural gas dissipates from the burner and operates under a high voltage. Also, the continuity of the flames is controlled with a thermocouple secured in vicinity of the burner on the device. An electronic control circuit located on the device is connected with an AC power supply and functionally drives the igniter and the thermocouple together.

US2002197575 discloses a re-ignition system eliminating the repeating circuits in the control card. Accordingly, an automatic detector of flame-out and the re-ignition system for the burner comprise an igniter. The igniter includes a spark gap and a transformer. Transformer has a first winding and a second winding. Spark gap is connected across the second winding of the transformer. A switch is in electrical communication with the primary winding such that when the switch is in a first state, electrical current may flow through the primary winding and when the switch is in a second state, electrical current may not flow through the primary winding. The system comprises at least one flame detector having an output indicating the presence of a flame. A programmable circuit having an input for receiving the output of the flame detector and an output for triggering the spark generator is provided. A method of ignition is also provided.

Such systems are equipped with a thermocouple for controlling the presence of the flame. When the flame provided from the burner is discontinued, thermocouple generates a flame-out signal by cooling down. However, detection of the flame-out condition by the thermocouple is in seconds and this causes a delay for re-ignition system to turn on.

SUMMARY OF THE INVENTION

The object of the invention is to eliminate the need for the use of thermocouple in re-ignition systems using direct current.

In order to achieve abovementioned objects, the invention relates to a re-ignition system for gas devices, comprising an electrode element provided next to a burner; an igniter connected with the electrode element for transmitting electrical signal and providing a spark arc with high voltage towards burner from electrode element in ignition mode; and an ignition control unit. The re-ignition system also comprises at least one battery providing direct current; a flame detection unit in which the distance of the spark gap is also arranged at a distance to receive a flame presence signal by flame rectification of the electrode element and which triggers the ignition to take into the ignition mode when the flame presence signal is discontinued and a transformer which converts the direct current supplied through the battery from one inlet to alternating current at an outlet and is connected with the ignition control unit and flame detection unit to feed an enabling electrical signal. The definition of an enabling electrical signal is an electric charge in the configuration enabling the flame detection unit to detect the flame presence by flame rectification and also enabling the ignition control unit to switch to ignition mode. In a possible embodiment, enabling electrical signal is an alternating current signal providing charge of at least 100 volts and more than 1 kHz to the flame detection unit. Transformer allows the electrode element to sense the flame presence and to serve as a igniter carrying out re-ignition when the flame is discontinued by feeding the direct current provided by the battery to flame detection unit and ignition control unit.

In a preferred embodiment of the invention, the transformer is configured that the alternating current provided at the outlet provides frequency between 0.5-5 kHz, particularly 1-3 kHz. In this case, it has been detected that the alternating current, in which the transformer converts the direct current from the battery, can transmit a flame presence signal to the flame detection unit by flame rectification of the electrode element provided at the distance of the burner and the spark. In this way, it is possible to both provide spark to the burner by a single electrode element and perform flame presence control and the need for use of an additional flame presence sensor, for example thermocouple is eliminated. It is a surprising result that the selected range of the frequency provides flame rectification for the electrode elements used in known igniter structures, and that this is not provided in other frequencies.

In a preferred embodiment of the invention, the transformer is configured that the alternating current provided at the outlet provides voltage between 100-400 volts. This voltage value allows the re-ignition system to be operated with batteries simply providing lower values such as 3 volts. Thereby, a compact structure is obtained in the re-ignition system and it is made possible to use thereof in recreational devices or gas domestic appliances.

In a preferred embodiment of the invention, the spark gap is arranged to be between 0.1-1. Such a distance of spark gap provided between the burner and electrode element is sufficient for both sparkover of the electrical arc and for flame presence detection by flame rectification through the electrode element.

A preferred embodiment of the invention includes a ceramic isolator wrapped around the electrode element. Ceramic isolator allows the user to be protected at the alternating current presence required for both producing flame by the electrode element and for carrying out the flame presence detection by flame rectification.

In a preferred embodiment of the invention, transformer includes a module coupled with oscillator. Thereby, it is possible to direct current provided by the battery via a compact module to an alternating current at preset frequency.

A preferred embodiment of the invention includes a flame detection unit from the outlet of the transformer and a parallel connection feeding the alternating current to the ignition control unit. It makes it possible to continuously provide electric charge during the lifetime of the battery to the ignition control unit that provides both transmission of the alternating current provided by the transformer with parallel circuit to the flame detection unit for the flame rectification and at the same time switching to the ignition mode according to the flame presence condition.

In a preferred embodiment of the invention, the ignition detection unit includes a first outlet connected to the ignition control unit to transmit electrical signal and a second outlet connected to the igniter to feed alternating current.

A preferred embodiment of the invention is a gas cooker comprising a re-ignition system in an embodiment described above.

DETAILED DESCRIPTION OF THE INVENTION

In this detailed description, the development of the invention has been described without any limitation and only with reference to the examples for a better explanation of the subject.

Figure 1:
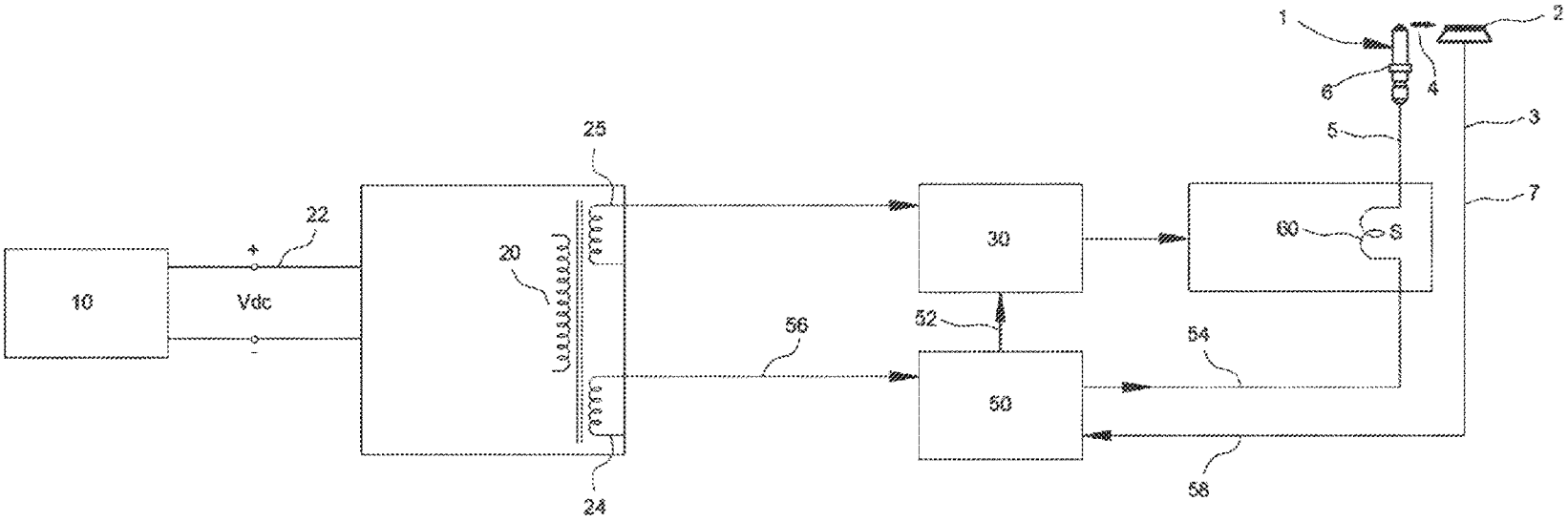
FIG. 1 is electrical diagram view of a representative embodiment of the re-ignition system fed with direct current that detects the flame with alternative current in ignition position according to the invention.

FIG. 1 shows the electrical diagram of a representative embodiment of a compact re-ignition system used in a recreational device. A burner (2) producing a gas-air mixture from the ambient air by a gas supply (not shown) is located in the cooking part of the recreational device. An electrode element (1) is secured vertically to leave a space at the distance of the burner (2) and a spark gap (4). The spark gap (4) is arranged to be between 0.1-1 cm. The feed line (5) of a cable structure transmits high voltage to the electrode element (1). The high voltage is provided from a igniter (60) connected with a feed line to the electrode element (1). The igniter (60) consists of a coil having a first winding wound around an iron core and a second winding (not shown) spaced therefrom. Such igniter (60) is disclosed in PCT publication incorporated herein with reference to WO2019TR050825.

Figure 2:
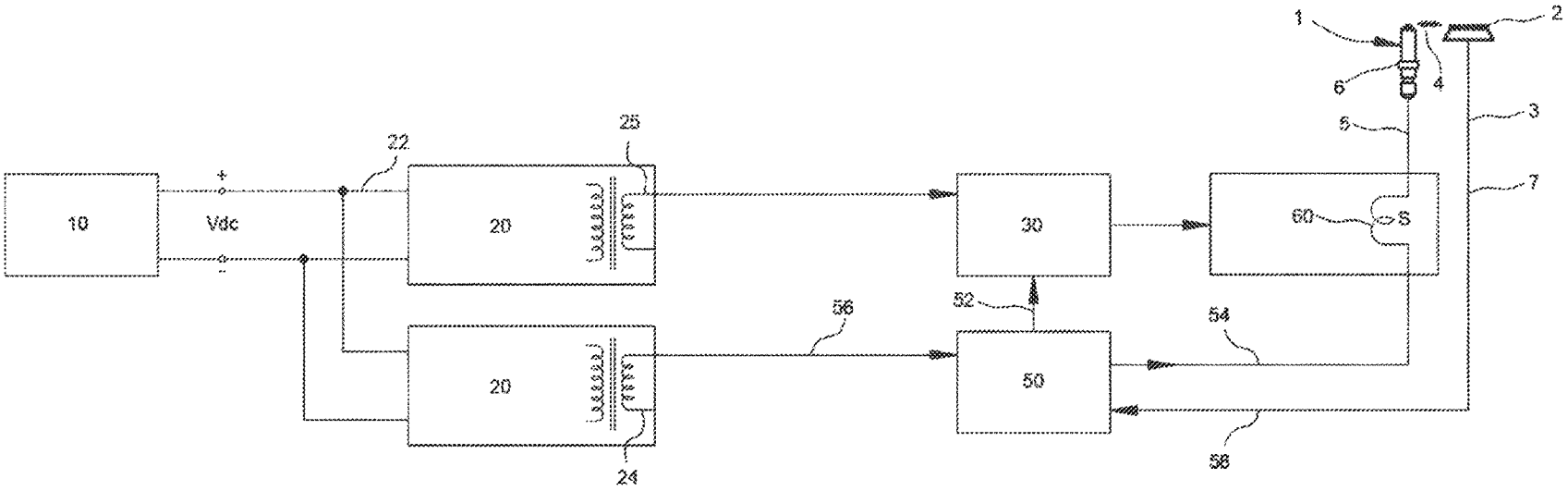
FIG. 2 is electrical diagram view of an application with two transformers of the re-ignition system fed with direct current that detects the flame with alternative current in ignition position according to the invention.

A battery (10) supplies current to the circuit by being placed into a chamber (not shown) to provide 3 volts of direct current. In the application shown in FIG. 1, the battery (10) is connected directly to the transformer (20) through an inlet (22) from its plus and minus poles such that it transmits direct current. The inlet (22) has the transmission path structure formed on a printed circuit board (not shown) to which the electronic components of the entire re-ignition system are secured. Transformer (20) is coupled with the oscillator and arranged to increase the 3 volts of direct current provided by the battery (10) to an alternating current at a frequency between 0.5-5 kHz and a value of 100-400 volts at an outlet (24). The transformer (20) has two parallel alternating current outlets. One (25) of these supplies alternating current to an ignition control unit (30). The other one (24) provides alternating current from a first inlet (56) to a flame detection unit (50) in parallel connection with the ignition control unit (30). In the embodiment shown in FIG. 2, the transformer (20) is in two independent units and one (25) of these units is connected to the ignition control unit (30) and the other one (24) to the flame detection unit (50). Flame detection unit (50) is operated by the flame rectification phenomenon. In this structure, a cable (7) connected to the flame detection unit (50) from one end to the burner (2) carries a flame presence signal (3). The circuit in which the flame presence signal is generated, is the electrode element (1) to which electrical signal is transmitted via feed line (5) through igniter (60) from the second outlet (54) of the flame detection unit (50), the flame extending along the spark gap (4) and the cable (7) which is connected to this with burner (2) and turns back to the flame detection unit (50) from the second inlet (58). When the flame presence signal (3) is discontinued in the circuit, the flame detection unit (50) ensures that the alternating current, which supplied from the outlet (25) by transmitting electrical signal to the ignition control unit (30) from the first outlet (52), is transmitted to the igniter (60). In this case, by creating a sparkover of arc from the spark gap (4) to the burner (2) by high voltage created in the igniter (60), the air-flammable gas mixture provided by the burner (2) ignites again.

When the flame is present over the burner (2), the flame allows current to flow between the burner (2) and the electrode element (1). However, when the current fed through the burner (2) reaches the electrode element (1), the flame provides partial rectification of the alternating current by acting as a current. This is called flame rectification. The flame detection unit (50) continuously monitors the partially rectified alternating current in the circuit completed by the flame extending along the burner (2), the electrode element (1) and the spark gap (4) therebetween. When the flame is interrupted by wind or any other external factor, the circuit is closed when the alternating current returns to normal and the presence signal (3) of the flame is interrupted. Thereby, the trigger signal for switching from flame detection unit (50) to ignition mode is transmitted to the ignition control unit (30) via the first outlet (52). The ignition control unit (30) switching into the ignition mode, transmits the alternating current from the outlet (25) of the transformer (20) to the igniter (60). When the re-ignition system re-ignites the air-flammable gas mixture supplied from the burner (2) by turning on the igniter (60), the flame detection unit (50) detects the flame presence signal (3) again with flame rectification and transmits a signal from the first outlet (52) of the ignition control unit (30) to exit the ignition mode. In this case, the ignition control unit (30) prevents the alternating current fed from the outlet (25) of the transformer (20) from reaching the igniter (60).

Figure 3:
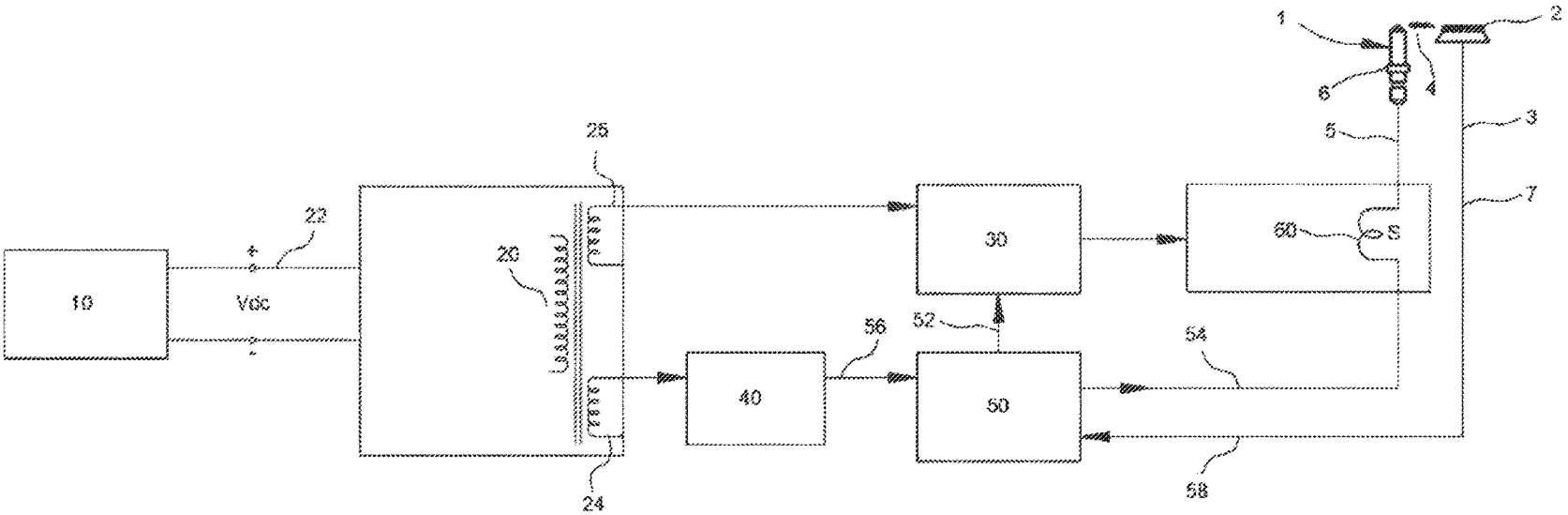
FIG. 3 is electrical diagram view of an embodiment of the re-ignition system fed with direct current that detects the flame with direct current according to the invention.

FIG. 3 shows the electrical diagram of a re-ignition system feeding the flame detection unit (50) with direct current. The DC signal reaching the inlet (22) has a frequency of 0.5-5 kHz and is increased to a value between 100-400 volts by the transformer (20) and thus it is fed from the outlet (25) to the ignition control unit (30) as alternating current. On the other hand, a second parallel outlet (24) is taken from the transformer (20) and given to a current rectification circuit (40). The current rectification circuit (40) transmits the load, which it outputs to a direct current greater than 100 volts, to the flame detection unit (50) from its first inlet (56). In this way, a circuit that operates with the resistance effect of the flame and is fed with direct current is formed, depending on the flame detection unit (50). When the flame is discontinued in the burner (2), the flame presence signal (3) disappears and the flame detection unit (50) sends a signal from its first outlet (52) by putting the ignition control unit (30) in ignition mode. The ignition control unit (30) generates high voltage in the igniter (60) by transmitting the alternating current directly received from the transformer (20) via the outlet (25) onto the igniter (60) and ensures that the high voltage received over the feed line (5) is transmitted from the electrode element (1) to the burner (2) as a sparkover of arc across the spark gap (4). With the formation of a spark, the air-combustible gas mixture supplied by the burner (2) ignites again and the flame rectification circuit opens when the flame completes the burner (2) and the electrode element (1), allowing the flame detection unit (50) to detect the flame presence signal (3). The flame detection unit (50), which detects the flame presence signal (3), takes the ignition control unit (30) out of ignition mode from its first outlet (52) and the ignition control unit (30) prevents the alternating current fed from the transformer (20) outlet (25) to reach the igniter (60).

Figure 4:
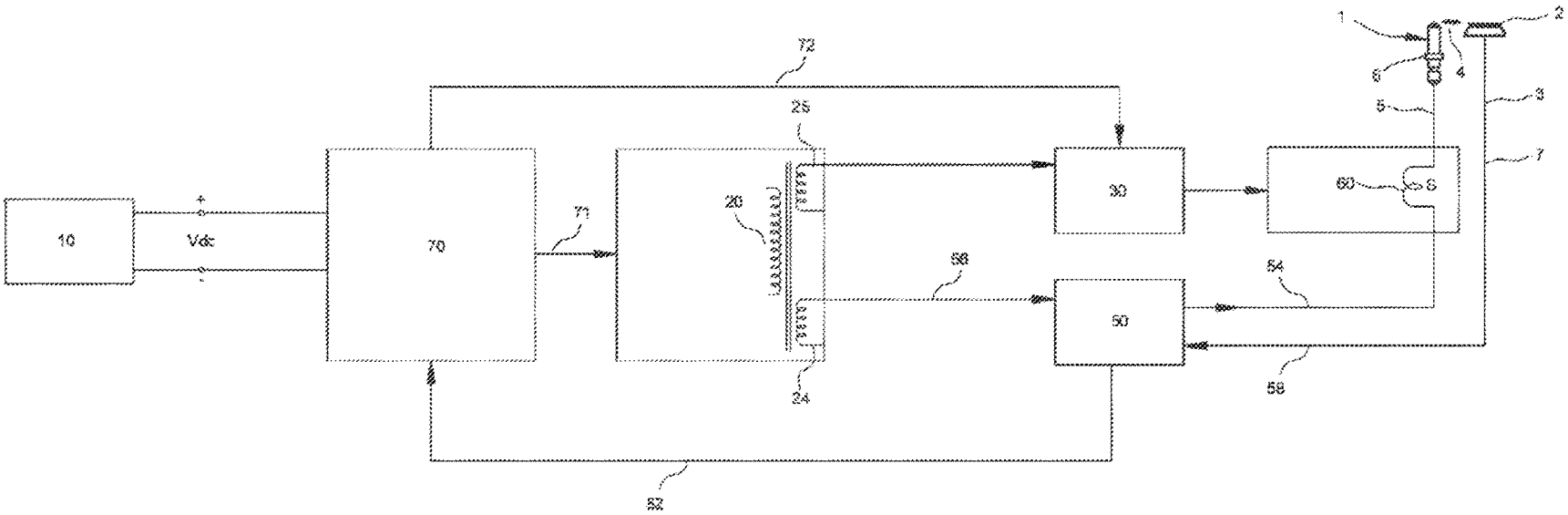
FIG. 4 is electrical diagram view of a representative embodiment of the re-ignition system fed with direct current that detects the flame with alternative current and has the property of power efficiency in ignition position according to the invention.

FIG. 4 is electrical diagram view of a representative embodiment of the re-ignition system fed with direct current that detects the flame with alternative current and has the property of power efficiency in ignition position according to the invention. It has a structure similar to the one shown in FIG. 1. However, with the exception that the battery (10) is connected to an electronic control unit (70) having a power control circuit. The electronic control unit (70) includes semi-conductor circuit elements such as logic circuit, micro-controller and transistor. Electronic control unit (70) is configured to draw power from the batter (10) if necessary and at other times to keep the power drawn from the battery (10) at the lowest level. By means of its power efficiency property, the electronic control unit (70) keeps the transformer (20) turned on continuously, as in FIG. 1 and FIG. 2, and does not continuously control the flame presence signal (3) via the flame detection unit (50). It activates the transformer (20) for a certain time (e.g. 1 second) from it first outlet (71) in a cycle, feeds alternating current from the outlet (24) of the transformer (20) to the flame detection unit (50) from the first inlet (56) and controls the presence of flame. When the flame detection unit (50) detects the flame presence signal (3), it transmits an electrical signal from its first outlet (52) to the electronic control unit (70). If the transmitted signal indicates that the flame is present, the electronic control unit (70) de-energizes the transformer (20) from its first outlet (71). In this case, the power drawn from the battery decreases to the lowest level. In this case, a certain time (e.g. 3 seconds) is waited and the cycle starts again. As long as the flame presence signal is sensed, the system continues to operate in power efficient mode. While the system is operating in the power efficient mode, if it is detected that the flame has been discontinued, the electronic control unit (70) continuously turns on the transformer (20) from its first outlet (71) and takes the system out of the power efficient mode. The electronic control unit (70) takes the ignition control unit (30) into ignition mode from its second outlet (72) and enables the igniter (60) to generate sparks. The igniter (60) continues to ignite until the flame signal (3) is received. When the flame presence signal (3) is sensed by the flame detection unit (50), by transmitting this from the first outlet (52) to the electronic control unit (70), it takes the ignition control unit (30) out of ignition mode from its second outlet (72), and the ignition of the igniter (60) stops. The electronic control unit (70) starts to turn on the transformer (20) again in a cycle from its first outlet (71), the system again returns to the power efficient mode again. In this way, the power drawn from the battery (10) is controlled, the power efficiency is increased and it is ensured that the battery is used for a longer time.

Figure 5:
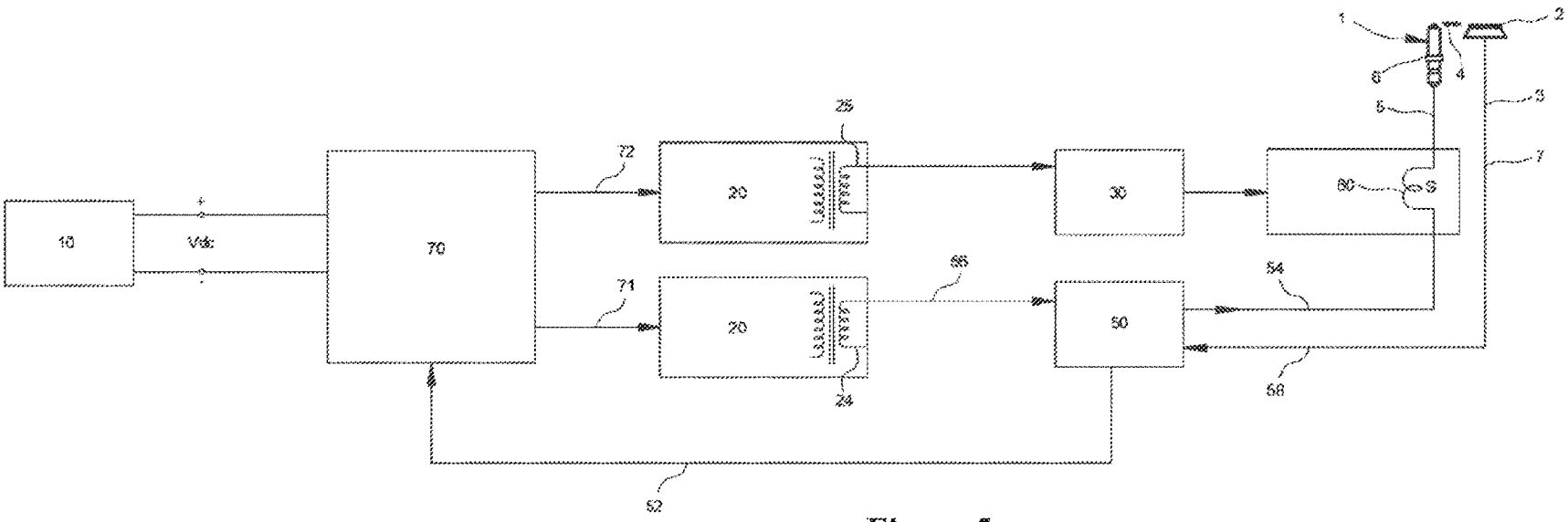
FIG. 5 is electrical diagram view of an application with two transformers of the re-ignition system fed with direct current that detects the flame with alternative current and has the property of power efficiency in ignition position according to the invention.

FIG. 5 is electrical diagram view of an application with two transformers of the re-ignition system fed with direct current that detects the flame with alternative current and has the property of power efficiency in ignition position according to the invention. It includes the same elements as FIG. 4, except that two transformers (20) are used. The flame detection unit (50) and the ignition control unit (30) are connected to a different individual transformer (20) connected with the electronic control unit (70) fed by the battery (10) to transmit electrical signal. Further, the igniter (60) is fed from a single transformer (20) to which the ignition control unit (30) is connected and different from the ignition detection unit (50).

Figure 6:
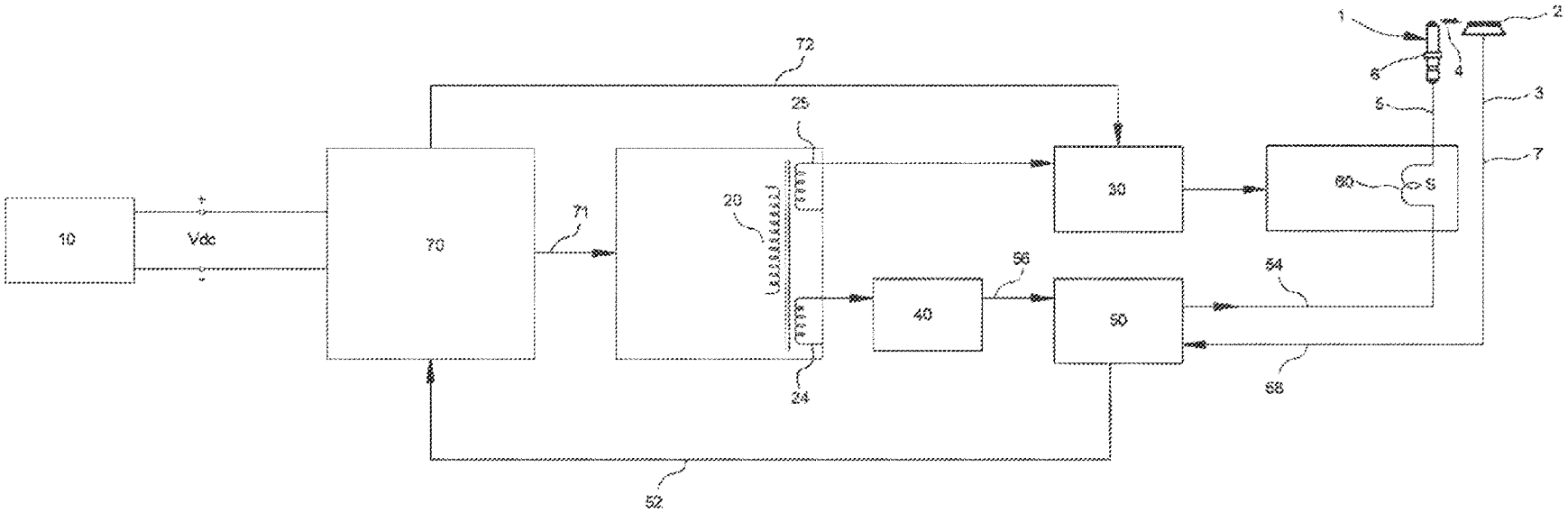
FIG. 6 is electrical diagram view of an embodiment of the re-ignition system fed with direct current that detects the flame with direct current and has the property of power efficiency according to the invention.

FIG. 6 is electrical diagram view of an embodiment of the re-ignition system fed with direct current detecting the flame with direct current, having the property of power efficiency according to the invention. With having the same structure as embodiment given in FIG. 3, the battery (10) is not connected directly and it is connected to the system through electronic control unit (70). The electronic control unit (70) includes semi-conductor circuit elements such as logic circuit, micro-controller or transistor. Electronic control unit (70) is configured to draw power from the batter (10) if necessary and at other times to keep the power drawn from the battery (10) at the lowest level as in FIG. 4. Electronic control unit (70) does not keep the flame detection unit continuously turned on as in FIG. 3, but turns it on for a certain time at certain time intervals. In this way, it controls the power drawn from the battery (10), increases the power efficiency and ensures that the battery (10) is used for a longer time.

Figure 7:
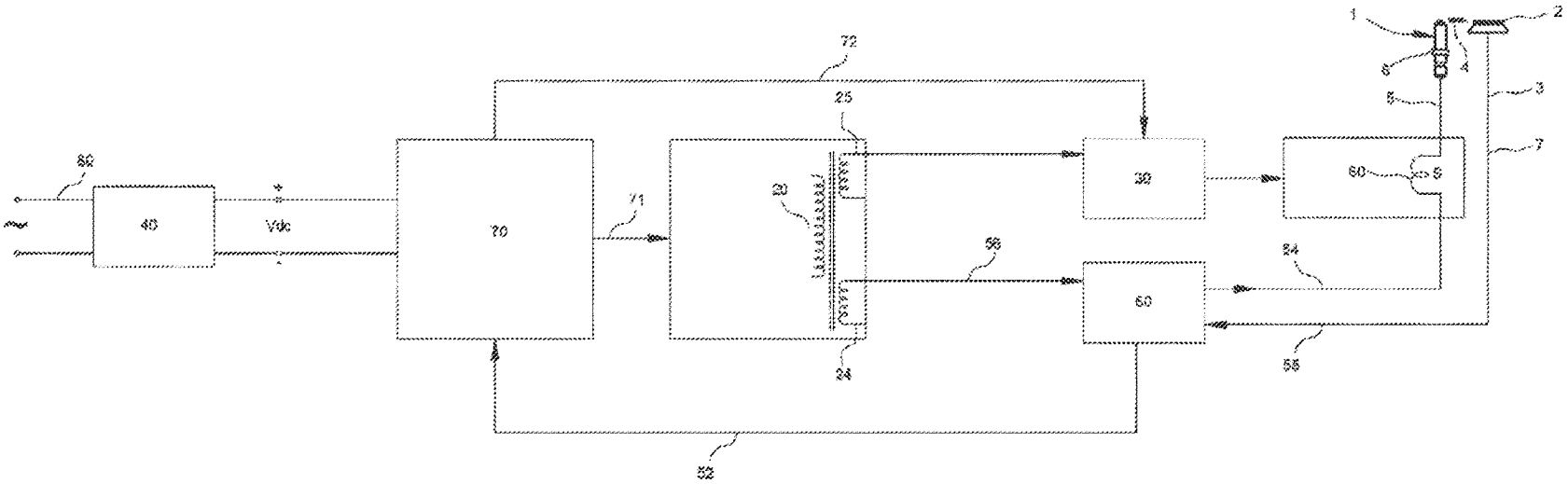
FIG. 7 is electrical diagram view of a representative embodiment of the re-ignition system fed with direct current that detects the flame with alternative current and has the property of power efficiency, showing that it is operated via mains voltage in ignition position according to the invention.

FIG. 7 is electrical diagram view of a representative embodiment of the re-ignition system fed with direct current that detects the flame with alternative current and has the property of power efficiency, showing that it is operated via mains voltage in ignition position according to the invention. It has a similar structure with FIG. 4. However, the difference is that the system is operated by the mains voltage (e.g. 110 volts, AC) supplied from a mains connection (80). Instead of battery (10), direct current voltage obtained by being rectified via current rectifying circuit (40) of the mains voltage feeds the system.

Figure 8:
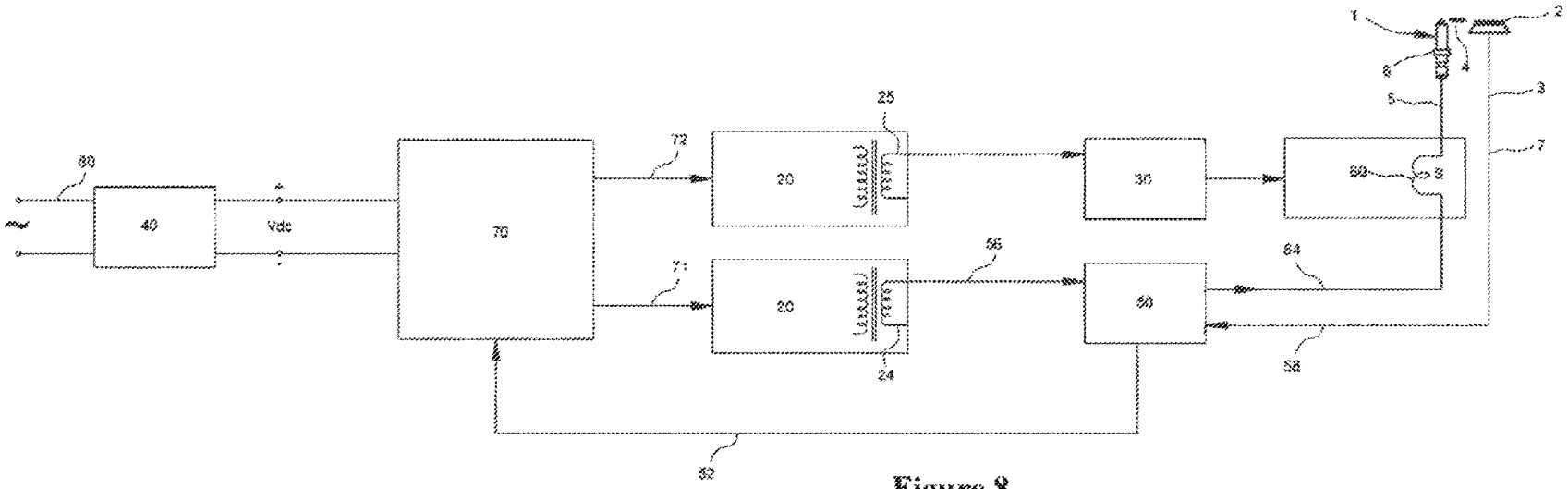
FIG. 8 is electrical diagram view of an application with two transformers of the re-ignition system fed with direct current that detects the flame with alternative current and has the property of power efficiency, showing that it is operated via mains voltage in ignition position according to the invention.

FIG. 8 is electrical diagram view of an application with two transformers of the re-ignition system fed with direct current that detects the flame with alternative current and has the property of power efficiency, showing that it is operated via mains voltage in ignition position according to the invention. While it has the same structure as FIG. 7, the only difference is that two transformers (20) are used. Flame detection unit (50) is fed by a separate transformer (20).

| REFERANCE NUMBERS |
|---|
| 1 Electrode element |
| 2 Burner |
| 3 Flame presence signal |
| 4 Spark gap |
| 5 Feed line |
| 6 Ceramic isolator |
| 7 Cable |
| 10 Battery |
| 20 Transformer |
| 22 Inlet |
| 24 Outlet |
| 25 Outlet |
| 30 Ignition control unit |
| 40 Current rectifying circuit |
| 50 Flame detection unit |
| 52 First outlet |
| 54 Second outlet |
| 56 First inlet |
| 58 Second inlet |
| 60 igniter |
| 70 Electronic control unit |
| 71 First outlet |
| 72 Second outlet |
| 80 Mains connection |

The invention claimed is:

1. A re-ignition system for a gas device comprising:

an electrode element provided at a distance of a spark gap next to a burner;

an igniter in communication with the electrode element configured to transmit a first electrical signal and to provide a spark arc towards a burner from the electrode element in an ignition mode;

an ignition control unit driving the igniter to switch the ignition mode;

at least one battery providing direct current;

a flame detection unit in which the distance of the spark gap is arranged to enable the flame detection unit to receive a flame presence signal by flame rectification via the electrode element, wherein the flame detection unit is configured to trigger the ignition control unit to switch to the ignition mode when the flame presence signal is interrupted, and wherein the flame presence signal is embodied on a current that bypasses the ignition control unit; and a transformer converts the direct current supplied by the battery from one inlet of the transformer to first alternating current at outlets of the transformer and is connected with the ignition control unit and flame detection unit to feed a second electrical signal, wherein the ignition detection unit includes a first outlet connected to the ignition control unit to transmit a third electrical signal and a second outlet connected to the igniter to feed a second alternating current.

2. A re-ignition system according to claim 1, wherein the transformer is configured such that the first alternating current provided at one of the outlets of the transformer is set to a frequency between 0.5-5 kHz, particularly 1-3 kHz.

3. A re-ignition system according to claim 1, wherein the transformer is configured such that the first alternating current provided at one of the outlets of the transformer is set to a voltage between 100-400 volts.

4. A re-ignition system according to claim 1, wherein the spark gap is arranged between 0.1-1 cm.

5. A re-ignition system according to claim 1, wherein a ceramic isolator is wrapped around the electrode element.

6. A re-ignition system for a gas device comprising:

an electrode element provided at a distance of a spark gap next to a burner;

an igniter in communication with the electrode element for transmitting configured to transmit a first electrical signal and to provide a spark arc towards a burner from the electrode element in an ignition mode;

an ignition control unit driving the igniter to switch the ignition mode;

at least one battery providing direct current;

a flame detection unit in which the distance of the spark gap is arranged to enable the flame detection unit to receive a flame presence signal by flame rectification via the electrode element, wherein the flame detection unit is configured to trigger the ignition control unit to switch to the ignition mode when the flame presence signal is interrupted, and wherein the flame presence signal is embodied on a current that bypasses the ignition control unit; and a transformer converts the direct current supplied by the battery from one inlet of the transformer to alternating current at outlets of the transformer and is connected with the ignition control unit and flame detection unit to feed a second electrical signal, wherein a direct current converter is provided between the flame detection unit and the transformer.

7. A re-ignition system according to claim 1, wherein the transformer includes a module coupled with oscillator.

8. A re-ignition system according to claim 1, further comprising a parallel connection feeding the first alternating current to the flame detection unit from one outlet of the outlets of the transformer and to the ignition control unit from another outlet of the outlets of the transformer.

9. A gas cooker comprising a re-ignition system according to claim 1.

* * * * *